United States Patent [19]

Lührs et al.

[11] Patent Number: 4,974,506

[45] Date of Patent: Dec. 4, 1990

[54] SPINDLE PRESS

[75] Inventors: Hermann Lührs, Grevenbroich; Kurt Tegtmeyer, Salzgitter; Wolfgang Werner, Braunschweig, all of Fed. Rep. of Germany

[73] Assignee: Saltzgitter Maschinenbau GmbH, Salzgitter, Fed. Rep. of Germany

[21] Appl. No.: 252,272

[22] PCT Filed: Nov. 4, 1987

[86] PCT No.: PCT/EP87/00672

§ 371 Date: Jul. 25, 1988

§ 102(e) Date: Jul. 25, 1988

[87] PCT Pub. No.: WO88/04233

PCT Pub. Date: Jun. 16, 1988

[30] Foreign Application Priority Data

Dec. 3, 1986 [DE] Fed. Rep. of Germany ..... 3641250

[51] Int. Cl.[5] ..... B30B 9/12

[52] U.S. Cl. ..... 100/102; 100/117; 100/127; 100/145; 100/150

[58] Field of Search ..... 100/935, 104, 110, 117, 100/144–150, 127, 102; 403/109; 464/162, 172

[56] References Cited

U.S. PATENT DOCUMENTS

| | | | |
|---|---|---|---|
| 1,608,158 | 11/1926 | Benson | 464/162 |
| 1,815,559 | 7/1931 | Garrigus | 464/162 |
| 2,613,060 | 10/1952 | Trahan | 464/162 X |
| 2,664,814 | 1/1954 | Ahlborn | 100/147 X |
| 2,709,957 | 6/1955 | Armstrong | 100/147 X |
| 2,912,923 | 11/1959 | Jung | 100/117 |

FOREIGN PATENT DOCUMENTS

| | | | |
|---|---|---|---|
| 830298 | 2/1952 | Fed. Rep. of Germany . | |
| 1910234 | 10/1969 | Fed. Rep. of Germany . | |
| 2365487 | 7/1975 | Fed. Rep. of Germany . | |
| 2641597 | 3/1978 | Fed. Rep. of Germany | 100/150 |
| 412253 | 9/1975 | U.S.S.R. | 100/117 |
| 742230 | 12/1955 | United Kingdom . | |
| 803216 | 10/1958 | United Kingdom . | |

*Primary Examiner*—Harvey C. Hornsby
*Assistant Examiner*—Stephen F. Gerrity
*Attorney, Agent, or Firm*—Michael J. Striker

[57] ABSTRACT

A spindle press (1) comprises a housing (3) with an upper part (2) and a lower part (5). A press spindle (16) is supported with an upper bearing (14) in a cover (11) of the upper part (2) and with a lower bearing (19) in the lower part (5) so as to be rotatable. The press spindle (16) comprises a hollow spindle body (27) with perforations (38) for pressed out fluid, compressor wings (56) and worm wings (57) being placed on the spindle body (27) externally. Interruptors (26), which are fastened at the housing (3), extend between these wings in a plurality of axial planes. The housing comprises a screen casing (22) permeable for the pressed out fluid and also a spray casing (21) at a distance outside of the latter. The pressed out fluid is guided away through a dewatering arrangement (30) of the lower part (5). The lower part (5) rests on a vertical frame (7) which encloses a telescoping drive pipe (52) and, further down, a drive arrangement (12) which drives the drive pipe (52) in a rotating manner. The drive pipe (52) is connected with the spindle body (27) within the lower bearing (19).

18 Claims, 8 Drawing Sheets

SPINDLE PRESS

BACKGROUND OF THE INVENTION

The invention is directed to a spindle press. More particularly, the present invention relates to a vertically arranged spindle press for pressing put fluid from a material, for example sugar beet pulp, which has a housing with an upper part including a spray casing and a screen casing forming an annular space for guiding away pressed out fluid therebetween, and also a lower part; a press spindle rotatably supported in the housing by upper and lower bearings, dewatering means connected with the annular space between the casings and with the interior of the hollow press spindle, filling means for feeding the material to be pressed into the upper part, and a drive which includes drive means and a drive pipe rotatable by the drive means and rotating the spindle.

In a known spindle press of this type (DE-OS No. 26 41 597), which is constructed as a beet pulp press, the drive pipe 6 is constructed as one piece and has a disadvantageously large length, since the lower part 10, 13 has a disadvantageously large overall height. An upper bearing of the spindle body 1 is not disclosed. The lower bearing 8 is located very low below the spindle body 1 at the lower end of the lower part 10, 13 and is connected with a bearing ring 7 which is fastened approximately at the longitudinal center of the drive pipe 6. Thus, the upper half of the drive pipe 6 is loaded not only by the driving torque, but also, in addition, by alternating axial forces from the inherent weight and the operation of the press spindle, including the material to be pressed. Therefore, at least this upper half must be laid out in a correspondingly more expensive manner. With respect to maintenance, assembly and repair, it is disadvantageous that the clearing wings 23 are fastened at the drive pipe 6. Another disadvantage, which also causes increased expenditure with respect to construction, is the collection and removal of the pressed out fluid in the lower part 10, 13 in two planes 27, 28 and 31, 32, 33 which are at a distance from one another in the axial direction, and the collection and removal of the pressed material in a third vertical plane 22, 23. Also, the step-up gear unit 5 of the drive arrangement is held so as to be fixed against relative rotation. Repairs, assembly and maintenance of the entire lower press area from the step-up gear unit 5 to the spindle body 1 are complicated and costly.

SUMMARY OF THE INVENTION

The invention has the object of facilitating maintenance, assembly and repair in the press area below the upper part of the housing, and reducing the load of the drive arrangement and the drive pipe.

In keeping with these objects and with others which will become apparent hereinafter, one feature of the present invention resides, briefly stated, in that the drive pipe has an upper part and a lower part which can be telescoped one inside the other and which are connected with one another by means of a coupling. Maintenance, assembly and repair in the lower press area down to the drive arrangement are facilitated in that either the upper pipe or the lower pipe are telescoped out of the work zone relative to the other part of the drive pipe. The coupling compensates for possible alignment errors and/or axial relative movements of the upper pipe and lower pipe which can occur in operation, e.g. because of thermal expansions. Thanks to the coupling, the upper pipe and lower pipe are freed from all external loads with the exception of the transmission of torque. These pipe parts can therefore be constructed so as to be relatively thin-walled. In addition, the drive arrangement is freed from axial forces, which could otherwise result, e.g. due to temperature expansions in the drive pipe, by means of the telescoping of the drive pipe.

Particularly simple axial relative movements of the upper pipe and the lower pipe, e.g. which serve for the the telescoping of these pipe parts or are a result of thermal expansions and operating deformations, are made possible with the tooth coupling including a plurality of teeth which are arranged radially between the upper pipe and the lower pipe.

The upper pipe can be supported in a particularly simple manner in its telescoped, lowest position by means of stops provided on the lower pipe at the bottom for supporting the upper pipe.

A particularly simple, operationally reliable and inexpensive connection of the lower pipe with the drive arrangement results in which the lower pipe is mounted on the bottom of a drive connection piece of the drive means, and a drive connection piece is supported externally on a drive bearing which is coaxial with the drive pipe. The drive bearing can be constructed, for example, as a sturdy ball bearing slewing connection. The drive connection piece can support a toothed ring, at least one pinion of a respective drive of the drive arrangement meshing with this toothed ring. A construction in which the pinion is overhung at the respective drive is particularly reliable in operation.

Maintenance, assembly and repair work, particularly at the drive arrangement, can be carried out in a particularly simple and rapid manner when externally on the drive pipe travelling paths can be provided for travelling rollers of a crane which is arranged above the drive means. The traveling paths preferably extend along the entire circumference of the drive pipe so that the crane has a work angle area of 360°.

It is possible that the crane is movable into a rest position out of contact with the travelling paths. In this case there is sparing of the traveling paths and the traveling mechanism of the crane when the latter is not required. For example, the crane can be raised into its rest position at the lower part of the housing.

In accordance with another feature of the present invention, the lower bearing is formed as a ball bearing slewing connection whose outer ring is mounted on the lower part of the housing and whose inner ring is mounted on a base connection piece of the base of the spindle body. In this case, the lower bearing is easily accessible for all purposes and can be accommodated in an advantageous manner with respect to construction. The particular arrangement of the lower bearing reduces the supported length of the press spindle to a minimum. Moreover, the upper pipe can be assembled so as to be completely free of the lower bearing with respect to the base connection piece of the spindle body.

Still another feature of the present invention is that the lower part of the housing rests on a vertical frame so as to be fixed from rotation, and the vertical frame encloses the drive parts and the drive means. This construction is simple, accessible from all sides and reliable in operation. The drive arrangement can be arranged on the floor or under the floor and is easily accessible in all cases.

A further feature of the present invention is that a base connection piece of a base of the spindle body extend in an upward direction with its ring beyond the base, the ring is sealed at its stop by a cover, a first annular duct for receiving pressed out fluid is formed between the rings, the base and a side wall of the spindle body, and the base has outlet connection pieces which are arranged on a circle concentric to the longitudinal axis of the press. These features result in a smooth collection and removal of the pressed out fluid which has penetrated into the spindle body. The base of the annular duct can be inclined in the direction of the outlet connection pieces in order to facilitate the drainage of the fluid. In a critical case, it is also possible to provide only one such outlet connection piece.

The cover can be provided with at least one opening which is closed by means of a lock via a labyrinth gap seal. This make it possible on the one hand for maintenance personnel to climb through the opening and, on the other hand, offer the possibility of an emergency dewatering in case of the occurrence of a backup of pressed out fluid in the interior of the spindle body. In this case, the fluid would penetrate through the labyrinth gap seal and would flow out through the drive pipe and a drain in the foundation.

The dewatering means includes at a distance below the base and radially outside the drive pipe an annular plate of the lower part of the housing and a plurality of annular walls arranged at a distance from one another concentrically to the longitudinal axis of the press and tightly connected with the annular plate. A first annular wall and a second annular wall extend until the vicinity of the base and define a second annular duct therebetween for receiving a lower end of the outlet connection pieces. The third annular wall extends in a circumferential contact with the screen casing while a fourth annular wall extends in a closer circumferential contact with the spray casing to form a third annular duct between the third and fourth annular walls. At least one outlet opening is provided between the first and second annular walls and between the third and fourth annular walls. With this feature a secure removal of the pressed out fluid from the upper part of the housing, on the one hand, and from the press spindle on the other hand is provided for within a compact space in the lower part of the housing. The base of the second annular duct and the third annular duct is preferably inclined in the direction of the outlet openings in order to achieve a more rapid and complete drainage of the pressed out fluid. An extremely low overall height and great rigidity of the lower part of the housing is a particular advantage of this manner of construction.

Each outlet opening can be connected with a connecting pipe below the annular plate via an intermediate connection piece. In such a construction, the pressed out fluid is guided out of the spindle press in an overseeable manner.

At least one line which opens in a downward direction can open in the upper region into the second annular duct and third annular duct. The lines are used on the one hand for the emergency dewatering of the second and third annular ducts in case the level of the pressed out fluid in the latter should rise too high. This can occur particularly when the spindle press is put into operation. Moreover, the lines serve as dispensing lines for introducing a foam inhibitor in the second and third annular ducts in case foam formation should occur therein because of a relatively high drip level of the pressed out fluid within the spindle press. The lines are open at the bottom so that no pressed out fluid flowing down from the top can flow in.

The second annular wall and the third annular wall define therebetween a fourth annular duct for receiving the pressed pulp. At least one clearing ring fastened on the spindle can revolve in the fourth annular duct. The annular plate can include in the area of the fourth annular duct at least one outage opening for the pressed pulp, which outage opening opens into a conveyor device. With this construction an effective mechanism for removing the pressed material from the lower part of the housing is provided in a minimum of space.

The upper end of the spindle is enclosed at a distance radially from it with a fifth annular wall which is fastened to the screen casing by outer web plates, and an annular seal is provided between the spindle body and the fifth annular wall. The annular space between the screen casing and the fifth annular wall serves for receiving the material to be pressed and is closed in a tight manner by means of an annular plate. In such a construction, a very effective filling area of the spindle press is provided. The material to be pressed can be introduced into the annular space in any desired manner, known per se.

The upper bearing is arranged on the upper part of the housing and is adjustable in the radial direction relative to the upper part by means of an adjusting arrangement. In this case, the upper bearing can be centered easily and securely relative to the housing. The upper bearing can comprise a self-aligning roller bearing, for example. Its arrangement at the upper part brings about a relatively small overall height of the entire spindle press.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
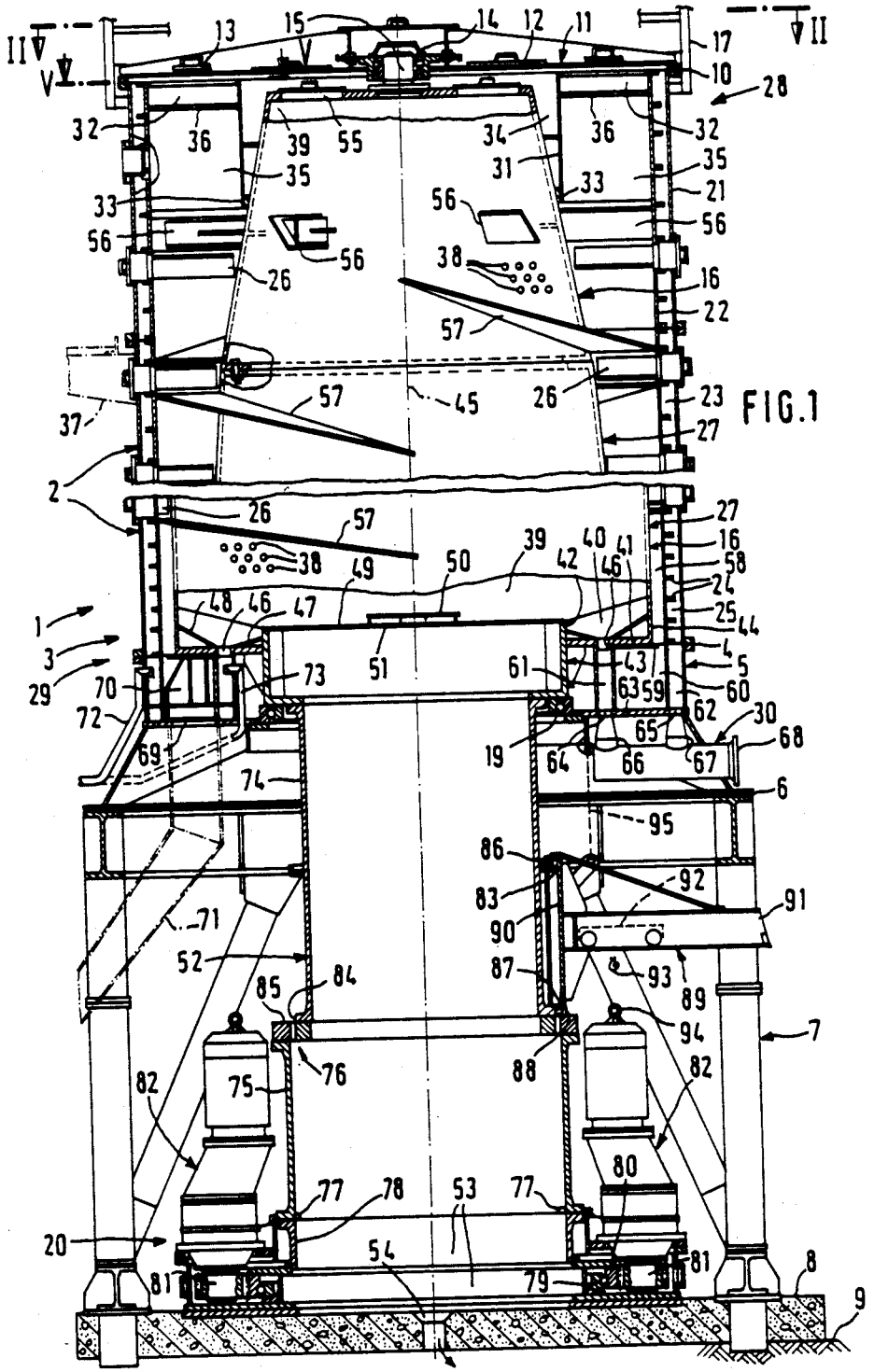
FIG. 1 shows a longitudinal section through a spindle press arranged in a vertically upright manner, wherein a part is broken away in the longitudinal direction.

FIG. 1 shows a spindle press 1 for pressing out fluid from sugar beet pulp, the spindle press 1 being arranged so as to be vertically upright. The spindle press 1 comprises a circular cylindrical upper part 2 of a housing 3. Also making up a part of the housing 3, in addition, is a lower part 5 which is screwed together with the upper part 2 along a plane 4. The lower part 5 is screwed again with a vertical frame 7 along a plane 6, the vertical frame 7 being anchored in a foundation 8 on the ground 9.

A cover 11, which is provided with manholes 12 further in in the radial direction and with observation openings 13 further outward, is screwed together with the upper part 2 along a plane 10. The cover 11 carries an upper bearing 14 for a shaft end 15 of a press spindle 16 in its center, the upper bearing 14 being constructed as a self-aligning roller bearing. The cover 11 is enclosed by a circulating railing 17.

The press spindle 16 is supported at the bottom so as to be rotatable in a lower bearing 19 of the lower part 5. The lower bearing 19 is constructed as a ball bearing slewing connection, and is drivable so as to rotate in a manner described below by means of a drive arrangement 20 which is arranged at the bottom in the vertical frame 7.

The upper part 2 of the housing 3 comprises a spray casing 21, which is divided into axially successive sections, and a screen casing 22 which is arranged within the spray casing 21 and is likewise divided into axially successive sections. An annular space 23 for guiding off fluid is provided between the spray casing 21 and the screen casing 22, the fluid is pressed out of the sugar beet pulp and passes outward through the screen casing 22 through screen holes, not shown. The screen casing 22 is provided with such screen holes on its entire effective axial length. The screen casing 22 is supported externally at supporting rings 24 which are arranged at an axial distance from one another and are held in turn by comb-like plates 25. The plates 25 extend coaxially, are arranged at a distance from one another in the circumferential direction and are fastened at an inner surface of the spray casing 21 (see also FIG. 5). Interruptors 26, which extend radially inward until the vicinity of a spindle body 27, are inserted in receiving openings of the upper part 2 from the outside in a plurality of vertical planes. The radial dimensioning of the interruptors 26 decreases from the top to the bottom in the same manner as the cross-sectional surface area of the spindle body 27 increases from an upper feed side 28 to a lower outlet side 29.

The annular space 23 is connected with a dewatering arrangement 30 in the lower part 5.

Figure 4:
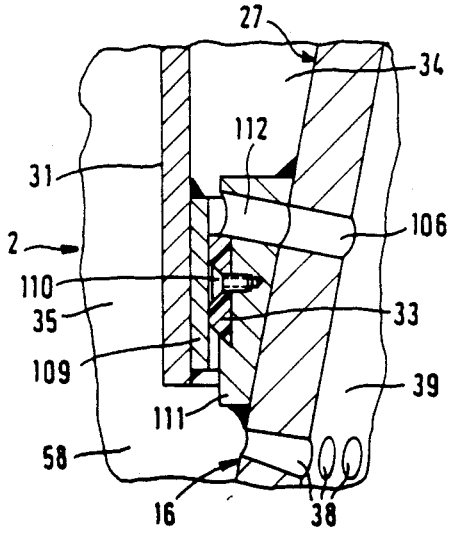
FIG. 4 shows the detail IV according to FIG. 3 in an enlarged manner.
Figure 5:
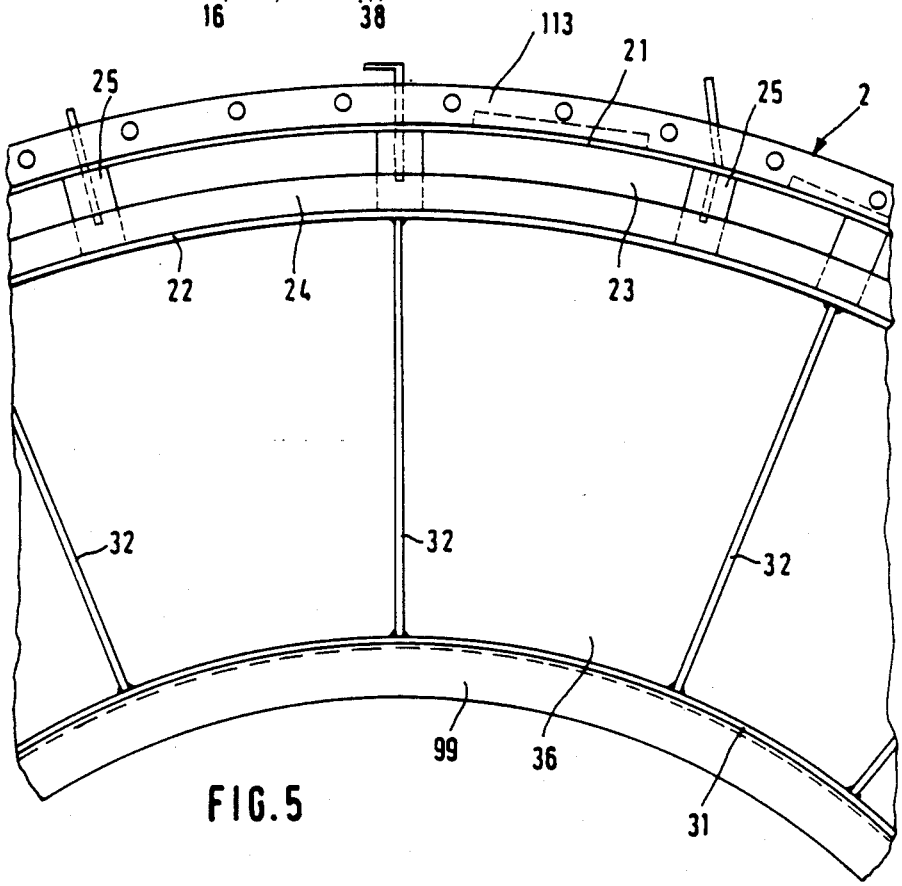
FIG. 5 shows the view according to line V—V in FIG. 1 in enlarged manner and without the press spindle.

An upper end area of the spindle body 27 is enclosed by a fifth annular wall 31 at a distance in the radial direction, which annular wall 31 is fastened at the screen casing 22 via outer web plates 32 (see FIG. 5). An annular seal 33, which prevents the material to be pressed and the fluid from penetrating up into a wedge-shaped annular space 34 between the upper end area of the spindle body 27 and the fifth annular wall 31, is provided between the spindle body 27 and the fifth annular wall 31. FIG. 4 shows details of the annular seal 33. An annular space 35 between the screen casing 22 and the fifth annular wall 31 serves to receive the material to be pressed, in this case, the wet pulp, and is tightly sealed at the top by means of an annular plate 36.

Figure 2:
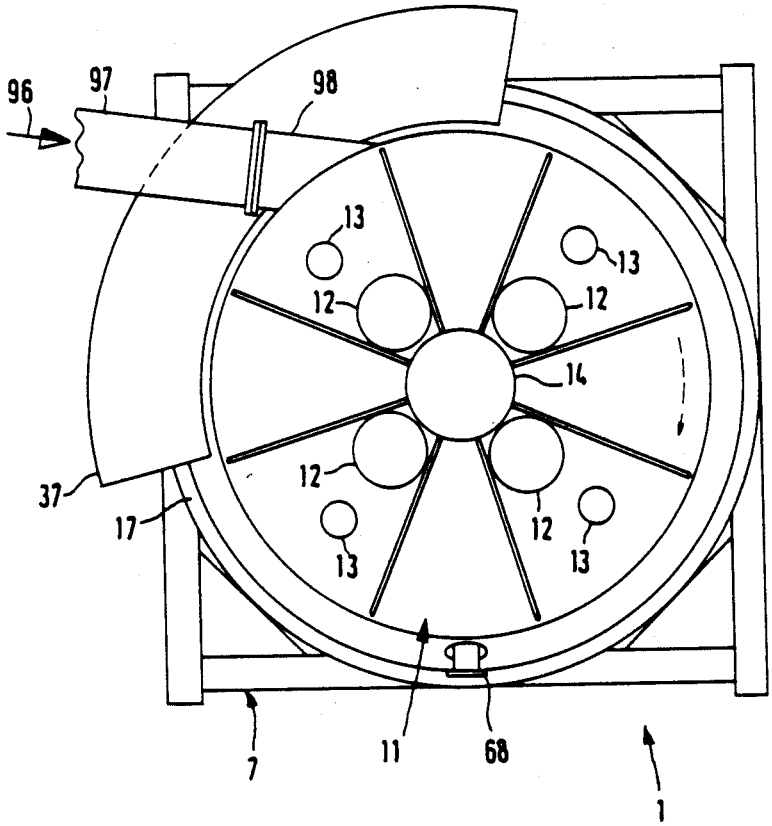
FIG. 2 shows the view according to line II—II in FIG. 1.

A work platform 37 which extends along approximately a third of the circumference is fastened at the outside of the upper part 2 (see FIG. 2).

The spindle body 27 is hollow and is provided with perforations 38 below the annular seal 33. The perforations 38 allow pressed out fluid to pass into an interior space 39 of the spindle body 27 and to flow downward therein. The interior space 39 ends at the bottom in a first annular duct 40 which is open at the top. The first annular duct 40 is defined by means of an annular base 41 of the spindle body 27, a ring 42 of a central base connection piece 43 of the spindle body 27, which ring 42 extends upward beyond the base 41, and a side wall 44 of the spindle body 27. The base 41 comprises outlet connection pieces 46 which are arranged on a circle which is concentric with the longitudinal axis 45 of the spindle press 1. Plates 47 and 48, which are shaped like truncated cones, are inserted in the first annular duct 40 and direct the pressed out fluid collected in the first annular duct 40 to the outlet connection pieces 46.

The ring 42 is closed at the top by means of a cover 49. The cover 49 comprises an opening 51 which is closed by means of a lock 50 via a labyrinth gap seal (see FIG. 6). The opening 51 serves, on the one hand, as a manhole and, on the other hand, for emergency dewatering in case a backup of pressed out fluid should occur in the interior space 39. This fluid then overcomes the labyrinth gap seal between the lock 50 and the opening 51 and flows downward through the base connection piece 43 and a drive pipe 52, which is flanged on at its lower side, and then through a corresponding central opening 53 of the drive arrangement 20 until this fluid finally arrives in an outlet 54 of the foundation 8.

Manholes 55 are provided in the spindle body 27 at the top. Below the annular seal 33, the spindle body 27 carries a plurality of compressor wings 56 in a horizontal plane, which compressor wings 56 are distributed along the circumference and lead to a precompression of the material to be pressed. The spindle body 27 also carries worm wings 57 which extend outward at least approximately in contact with the screen casing 22 and whose slope and axial distance from one another decrease from the feed side 28 to the outlet side 29.

The spindle body 27 is constructed of axially successive sections and screwed together and, with the circular cylindrical screen casing 22, defines an annular space 58 which decreases in diameter in a downward direction and receives the material to be pressed. The pressed pulp exits from the annular space 58, past a retaining ring 59, which is screwed on at the lower side of the base 41 and projects radially outward over the side wall 44, into a fourth annular duct 60 of the lower part 5 (see FIGS. 6 to 8).

A lower end of the outlet connection pieces 46 opens into a second annular duct 61 of the lower part 5. In a similar manner, the annular space 23 opens into a third annular duct 62 of the lower part 5 (see FIGS. 6 to 8). The second annular duct 61 and the third annular duct 62, as well as the fourth annular duct 60, are defined at the bottom by an annular plate 63. The annular plate 63 comprises outlet openings 64 and 65 for pressed out fluid, each of which is connected with a collecting pipe 68 via an intermediate connection piece 66 and 67 fastened below the annular plate 63.

The annular plate 63 is also provided in the area of the fourth annular duct 60 with two fall-out openings 69 for the pressed pulp, which fall-out openings 69 are arranged so as to lie opposite one another diametrically. A plurality of clearing wings 70, which feed the pressed pulp to the fall-out openings 69 and are fastened at the spindle body 27 at the bottom, revolve within the fourth annular duct 60 receiving the pressed pulp. A fall shaft 71, which guides the pressed pulp away for further use, is connected at each fall-out opening 69 at the bottom.

FIG. 1 shows the spindle press 1 in two sectional planes which are at a right angle to one another with reference to the longitudinal axis 45. This is clear from FIG. 7.

Two lines 72 and 73, which are arranged so as to lie opposite one another diametrically and open downward in the annular duct 61, 62, open into the second annular duct 61 and the third annular duct 62 respectively in its upper area. If the fluid level in the annular ducts 61, 62 rises too high, particularly when starting the spindle press, the lines 72, 73 serve for emergency dewatering. A foam inhibitor can flow through the lines 72, 73 in the opposite direction and can be added to the fluid in the annular ducts 61, 62 in this way.

The vertical frame 7 is constructed from a braced, very rigid framework and encloses the drive arrangement 20 and the drive pipe 52.

The drive pipe 52 comprises an upper pipe 74 and a lower pipe 75 which can telescope within one another and are connected with one another by means of a coupling 76. The coupling 76 is constructed as a tooth coupling whose teeth are arranged radially between the upper pipe 74 and the lower pipe 75. The lower pipe 75 is provided at the bottom with stops 77 upon which the upper pipe 74, which is telescoped relative to the lower pipe 75, can be supported. For this purpose, the screw connection of the upper pipe 74 with the base connection piece 43 is loosened. Next, the upper pipe 74, which is supported in a suitable manner, telescopes in a downward direction into the lower pipe 75. In so doing, the teeth of the tooth coupling 76 disengage from one another axially. Finally, the teeth of the upper pipe 74 come to rest on the stops 77 of the lower pipe 75. The lower bearing 19, in particular, is then easily accessible for maintenance and repair. In the reverse manner, the upper pipe 74 is telescoped out of the lower pipe 75 again after the maintenance and repair work is terminated and is mounted at its place shown in FIG. 1.

The lower pipe 75 is screwed together at the bottom with a drive connection piece 78 of the drive arrangement. If this screw connection is loosened, the lower pipe 75 can be telescoped in an upward direction relative to the upper pipe 74 in an analogous manner and can remain there until maintenance or repair work is concluded in the area of the drive arrangement 20.

The drive connection piece 78 is supported externally at a drive bearing 79 which is coaxial to the drive pipe 52 and carries a toothed ring 80 with teeth which face outward. Pinions 81 of drives 82 engage in the teeth. The drives 82 extend upward outside of the drive pipe 52 in such a way as to economize on overall length. As many drives 82 as are needed to provide the torque required for the rotational drive of the press spindle 16 are arranged around the toothed ring 80.

Figure 9:
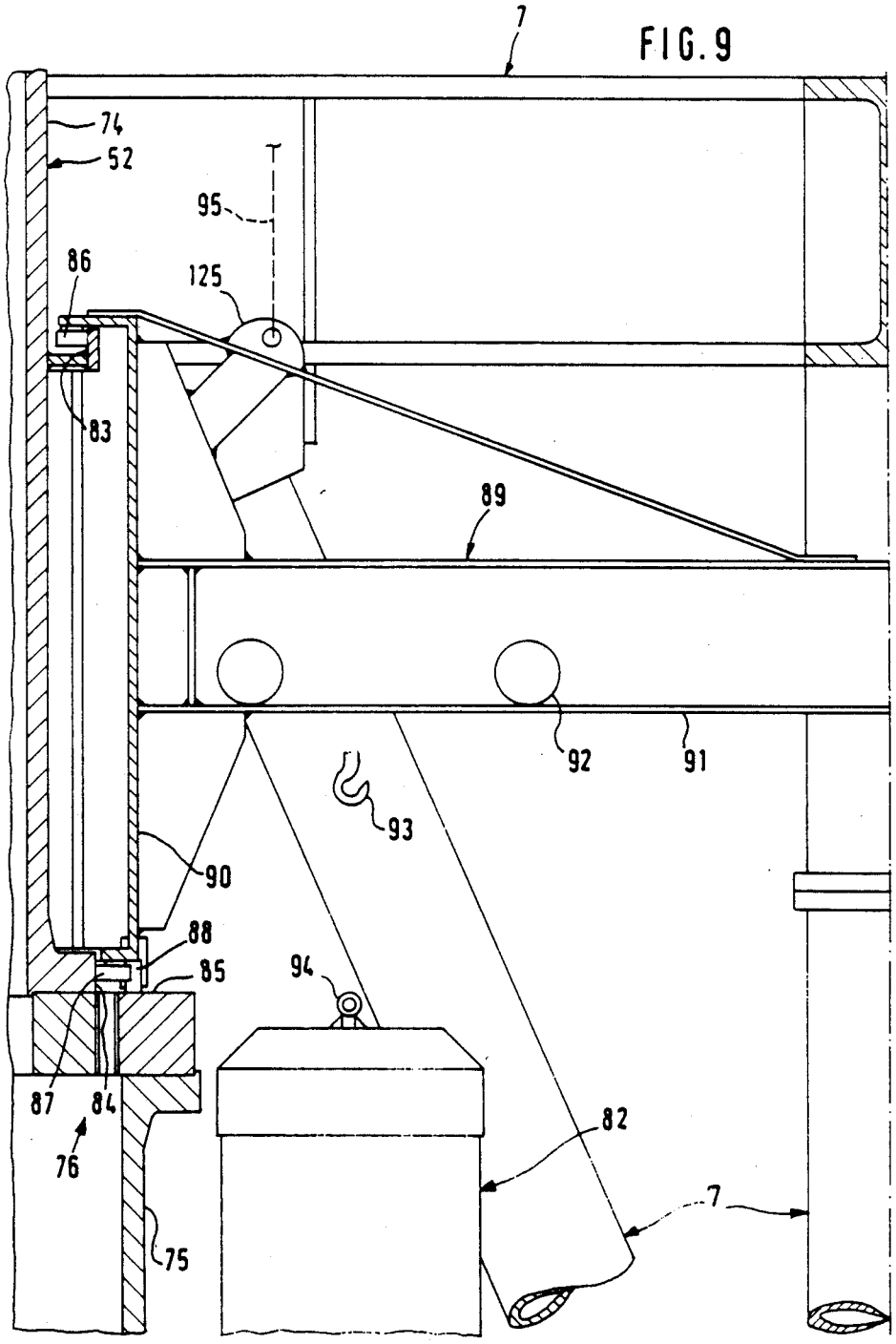

Traveling paths 83, 84 and 85 for traveling rollers 86, 87 and 88 of a crane 89 arranged above the drive arrangement 20 are provided externally at the drive pipe 52, which traveling paths 83, 84 and 85 extend around the entire circumference (see also FIG. 9). Two of the traveling rollers 86 to 88 are respectively provided at a distance from one another in the circumferential direction and are supported at a supporting frame 90 of the crane 89 so as to be rotatable. An overhang beam 91 of the crane 89 extends horizontally from the supporting frame 90, a traveling trolley 92 with a load hook 93 being drivable on the overhang beam 91 in a manner known per se. Each of the drives 82 can be installed and removed with the load hook 93 by means of a ring bolt 94.

If the crane 89 is not needed, it can be lifted out of the traveling paths 83 to 85 into an upper rest position with a hoist 95 which is fastened at the lower part 5 and is indicated in FIG. 1 in dashed lines.

Figure 3:
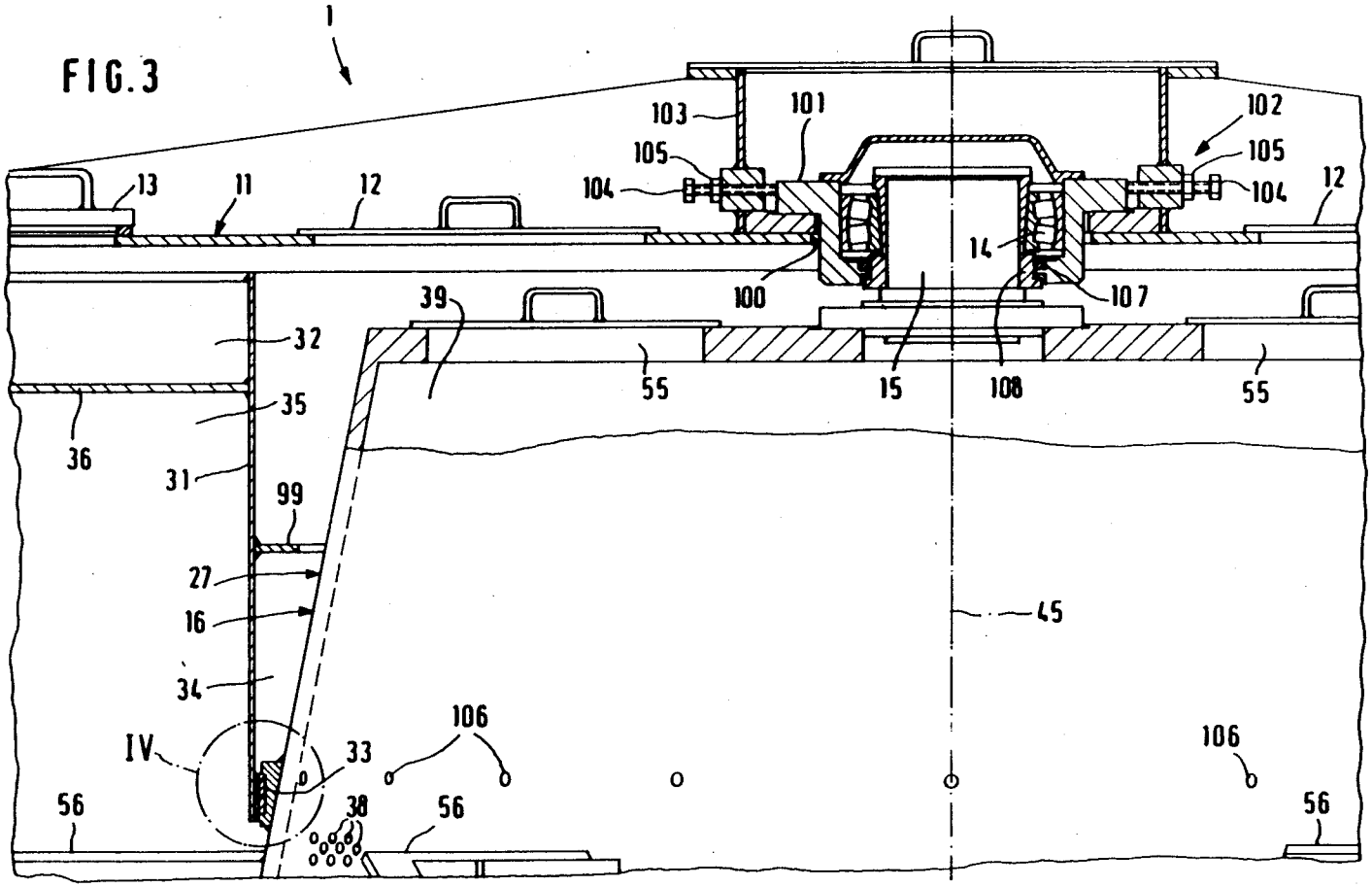
FIG. 3 shows a section from the head area of FIG. 1 in an enlarged manner.

FIG. 2 shows the top view of the spindle press 1 according to FIG. 1. The wet pulp is introduced into a filling connection piece 98 extending substantially tangentially relative to the upper part 2 in the direction of arrow 96 by means of a conveyor worm 97, which is only partially indicated. The filling connection piece 98 opens into the annular space 35 above the compressor wings 56 (FIG. 1). The working platform 37 facilitates work in the area of the conveyor worm 97 and the filling connection piece 98. According to FIG. 3, a stiffening ring 99 of the fifth annular wall 31 extends into the annular space 34.

A bearing bush 101 with radial play is inserted in a central opening 100 of the cover 11. The bearing bush 101 and, accordingly, the upper end of the press spindle 16 can be adjusted in the radial direction with an adjusting arrangement 102. The adjusting arrangement 102 comprises adjusting screws 104 which are screwed into a dome 103 of the cover 11, distributed along the circumference, and extend in the radial direction in contact with the bearing bush 101 and are secured in the desired radial position by means of a counternut 105.

The spindle body 27 is provided with a ring of dewatering holes 106 in a horizontal plane at the upper end of the annular seal 33 (see FIG. 4), through which condensation, which can form in the wedge-shaped annular space 34 and above the spindle body 27, can flow off into the interior space 39. The bearing bush 101 is carefully sealed relative to a ring 108 by means of a seal 107, the ring 108 being placed on the shaft end 5 in a tight manner, so that no lubricant can leak downward from the upper bearing 14.

In FIG. 4, a slide ring 109 of stainless steel is welded on inside the fifth annular wall 31 at the bottom. The annular seal 33, which can consist of the plastics material known under the trade name Teflon, for example, rests at the slide ring 109 at the inside. The annular seal 33 seals the annular space 58 relative to the wedge-shaped annular space 34 and within certain limits allows axial relative movements of the press spindle 16 relative to the upper part 2. In particular, the annular seal 33 prevents the material to be pressed and/or the fluid from reaching the annular space 34 from the annular space 58.

The annular seal 33 is constructed at the bottom in a dovetail manner and is secured in a circumferential groove of a retainer ring 111 of the spindle body 27 with countersunk screws 110. An outer continuation 112 of each dewatering hole 106 in the retainer ring 111 opens out externally at the lowest place on the wedge-shaped annular space 34, so as to ensure that fluid is removed from the latter into the interior space 39 in a complete and continuous manner.

FIG. 5 shows details of the construction of the upper end of the upper part 2. An assembly flange 113, which adjoins the plane 10 (FIG. 1), is welded on at the spray casing 21 at the top and externally.

Figure 6:
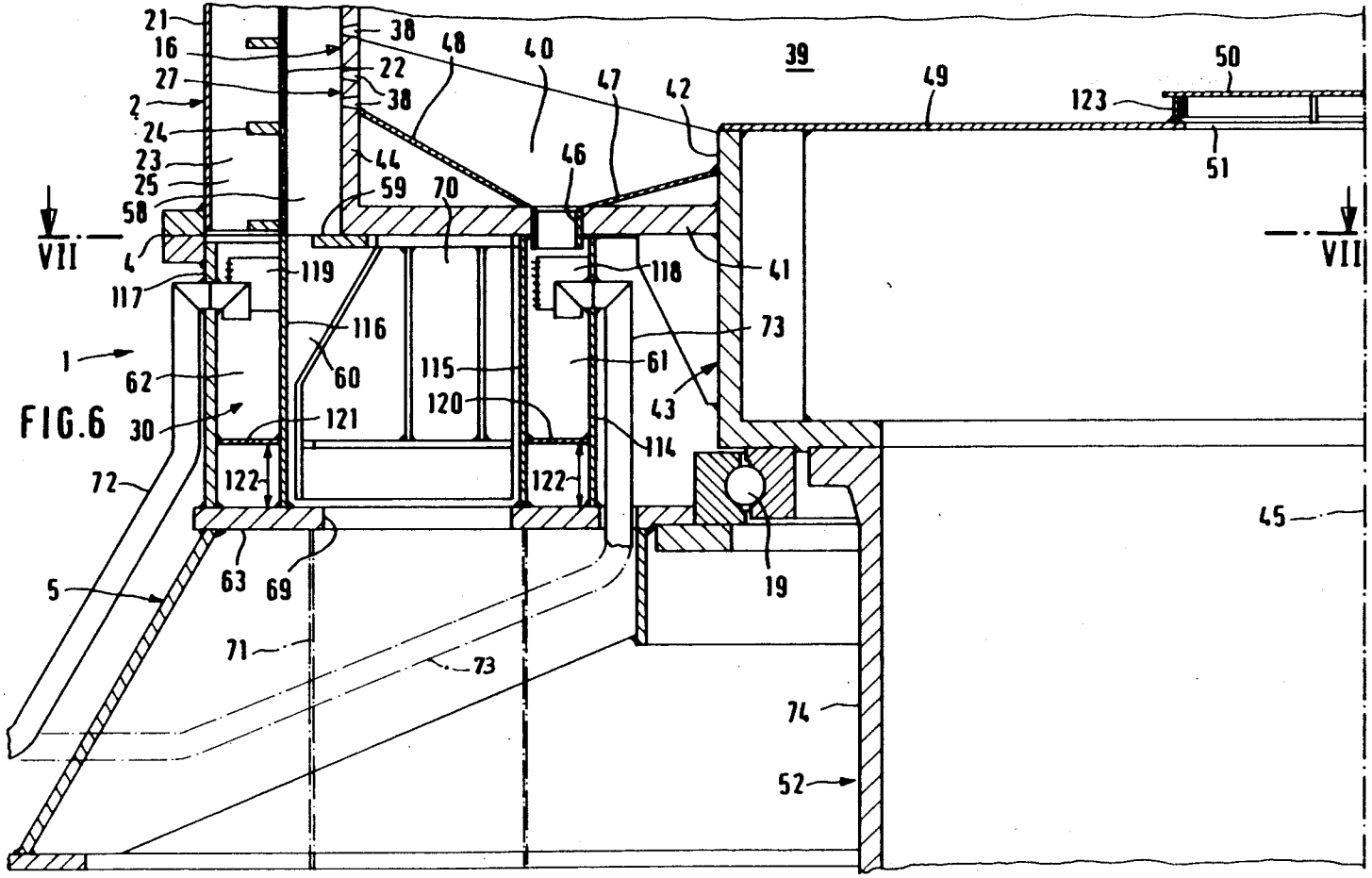
FIG. 6 shows a detail in the left-hand central area of FIG. 1 in an enlarged manner.

FIG. 6 shows the construction of the annular ducts 60 to 62 in a particularly clear manner. The second annular duct 61 and the third annular duct 62 are component parts of the dewatering arrangement 30.

The second annular duct 61 is defined by means of a first annular wall 114 and a second annular wall 115 arranged outside the latter at a distance, which are concentric with the longitudinal axis 45 and connected in a tight manner with the annular plate 63 by means of welding and extend until the vicinity of the base 41 of the spindle body 27.

In a similar manner, the third annular duct 62 is defined by means of a third annular wall 116 and a fourth annular wall 117 arranged at a distance radially outside the latter, which are concentric to the longitudinal axis 45 and are likewise connected in a tight manner with the annular plate 63 by means of welding. The third annular wall 116 extends in circumferential contact with the screen casing 22. The fourth annular wall 117 extends effectively in tight circumferential contact with the spray casing 21, wherein each of these elements is welded on at an outwardly extending assembly flange, the plane 4 being comprised between the latter.

Figure 7:
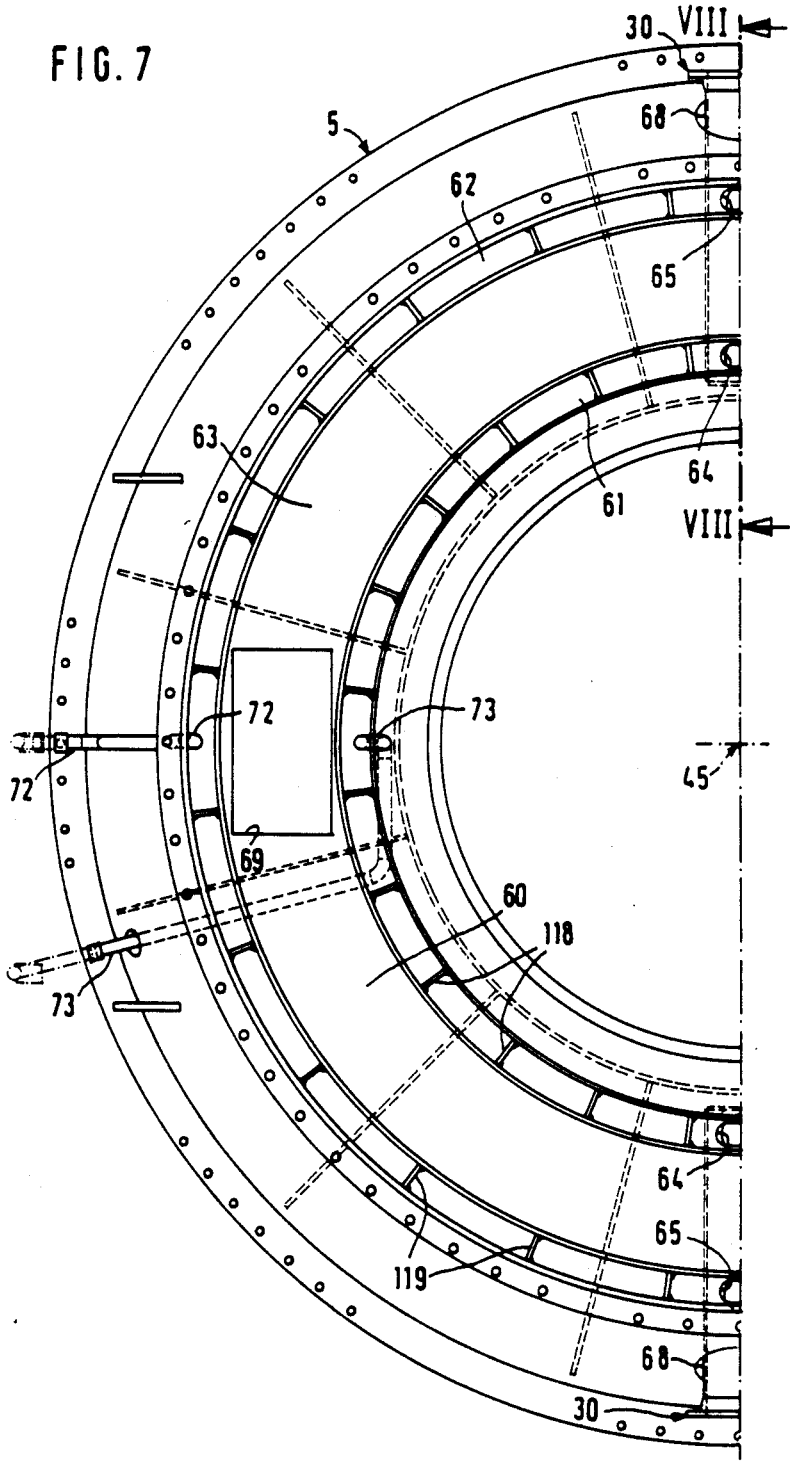
FIG. 7 shows a view according to line VII—VII in FIG. 6, but only of the lower part of the housing and in a reduced manner.
Figure 8:
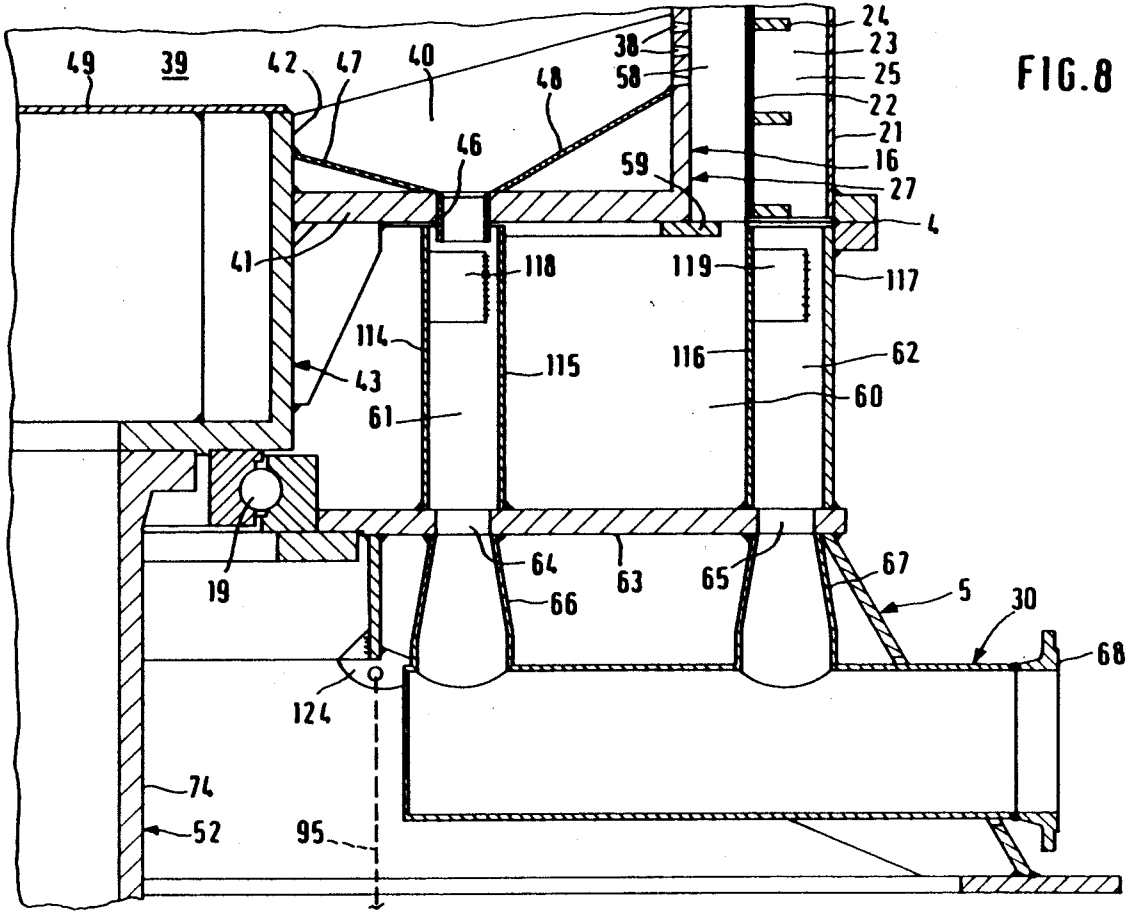
FIG. 8 shows a sectional view according to line VIII—VIII in FIG. 7 in an enlarged manner and FIG. 9 shows a detail on the right-hand side in the lower third of FIG. 1 in an enlarged manner.

In both the second annular duct 61 and the third annular duct 62, radial web plates 118 and 119 are welded in below the upper end for the purpose of strengthening (see also FIG. 7). The second annular duct 61 and the third annular duct 62 are defined at the bottom by means of a base plate 120 and 121 which is welded in in a tight manner between the adjacent annular walls 114, 115 and 116, 117 and drops from the highest point shown in FIG. 6 to the outlet openings 64, 65 (FIGS. 7 and 8). Thus, in FIG. 6, each of the base plates 120, 121 are at an equal distance 122 from the annular plate 63.

The portion of the line 73 located below the annular plate 63 is indicated in dash-dot lines in FIG. 6, since it lies above the drawing plane (see FIG. 7).

According to FIG. 6, an annular connection piece 123, in which the lock 50 is inserted with play, is welded on the cover 49 at the top outside the opening 51. A labyrinth gap seal is accordingly provided, by means of which pressed out fluid can flow downward out of the interior space 39 through the base connection piece 43 and the drive pipe 52 in case of emergency.

FIG. 7 shows that the dewatering arrangement 30 comprises two collecting pipes 68 which are arranged so as to be diametrically opposite one another. Although they are not shown in FIG. 7, the lines 72, 73 are also present in a two-fold manner and are arranged diametrically opposite one another. Thus, the foam inhibitor can be fed through the lines 72, 73 into the places in the annular ducts 61, 62, which places are the highest in terms of distance 122 and are shown in FIG. 6 and function to a certain extent as "divides", and can exert its full effect on the subsequent respective flow off path along a quarter circle.

In addition, two diametrically opposite fall-out openings 69 are provided for the pressed pulp, although they are not seen in FIG. 7.

FIG. 8 shows individual parts of the dewatering arrangement 30 in a particularly clear manner. A connection plate 124, which is welded on at the lower part 5 at the bottom and to which the hoist 95 is fastened, can also be seen.

A similar connection plate 125 is welded on at the crane 89 at the top according to FIG. 9. FIG. 9 also shows the construction and arrangement of the traveling paths 83 to 85 and traveling rollers 86 to 88 in detail.

It will be understood that each of the elements described above, or two or more together, may also find a useful application in other types of constructions differing from the types described above.

While the invention has been illustrated and described as embodied in a vertical spindle press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vertical spindle press for pressing out fluid from a material, such as sugar beet pulp, comprising a housing having a spray casing and a screen casing which is arranged within said spray casing so as to form an annular space therebetween; dewatering means connected with said annular space between said casings; a hollow spindle rotatable in said housing, forming with said screen casing an outlet annular gap for pressed material and being provided with a plurality of worm wings which extend outwardly substantially in contact with said screen casing, said hollow spindle having perforations for pressed out fluid and an interior space communicating with said dewatering means; filling means for feeding a material to be pressed into said housing; and a drive for driving said spindle in rotation and including drive means and a drive pipe which is driven by said drive means and drives said spindle from below, said drive pipe including an upper pipe member and a lower pipe member which are connected with one another and can be telescoped one inside the other and a coupling for connecting said upper pipe member and said lower pipe member with one another, said lower pipe member having a bottom region and is provided with a stop at said bottom region for supporting said upper pipe member upon telescoping in said upper pipe member downwardly relative to said lower pipe member.

2. A spindle press as defined in claim 1, wherein said casing has an upper feed side and a lower outlet side, said spindle having a cross-section which increases downwardly from said upper feed side to said lower outlet side, said worm wings having a slope and an axial distance from one another which decrease from said upper feed side to said lower outlet side.

3. A spindle press as defined in claim 1, wherein said drive means includes a drive bearing arranged coaxially with said drive pipe and a drive connection piece supported externally on said drive bearing, said lower pipe member having a bottom region which is mounted on said drive connection piece.

4. A spindle press as defined in claim 1; and further comprising a vertical frame, said housing having an upper part and a lower part, said lower part of said housing resting on said vertical frame so as to be fixed from rotation, said vertical frame enclosing said drive pipe and said drive means.

5. A spindle press as defined in claim 1, wherein said stop provided on said lower pipe member includes a plurality of stop members.

6. A vertical spindle press for pressing out fluid from a material, such as sugar beet pulp, comprising a housing having a spray casing and a screen casing which is arranged within said spray casing so as to form an annular space therebetween; dewatering means connected with said annular space between said casings; a hollow spindle rotatable in said housing, forming with said screen casing an outlet annular gap for pressed material and being provided with a plurality of worm wings which extend outwardly substantially in contact with said screen casing, said hollow spindle having perforations for pressed out fluid and an interior space communicating with said dewatering means; filling means for feeding a material to be pressed into said housing; a drive for driving said spindle in rotation and including drive means and a drive pipe which is driven by said drive means and drives said spindle from below, said drive pipe including an upper pipe member and a lower pipe member which are connected with one another and can be telescoped one inside the other and a coupling for connecting said upper pipe member and said lower pipe member with one another; and a crane for installing and removing said drive means, said crane being provided with a plurality of travelling rollers and arranged above said drive means, said drive pipe being provided with a plurality of travelling paths for said travelling rollers of said crane, said travelling paths being arranged externally on said drive pipe and extending in a circumferential direction.

7. A spindle press as defined in claim 6, wherein said crane is movable into a rest position out of contact with said travelling paths of said drive pipe.

8. A vertical spindle press for pressing out fluid from a material, such as sugar beet pulp, comprising a housing having a spray casing and a screen casing which is arranged within said spray casing so as to form an annular space therebetween; dewatering means connected with said annular space between said casings; a hollow spindle rotatable in said housing, forming with said screen casing an outlet annular gap for pressing material and being provided with a plurality of worm wings which extend outwardly substantially in contact with said screen casing, said hollow spindle having perforations for pressed out fluid and an interior space communicating with said dewatering means; filling means for feeding a material to be pressed into said housing; a drive for driving said spindle in rotation and including drive means and a drive pipe which is driven by said drive means and drives said spindle from below, said drive pipe including an upper pipe member and a lower pipe memeber which are connected with one another and can be telescoped one inside the other and a coupling for connecting said upper pipe member and said lower pipe member with one another; and an upper bearing and a lower bearing for rotatably supporting said spindle, said housing having an upper part and a lower part, said spindle having a base with a base connection piece, said lower bearing being formed as a ball bearing slewing connection with an outer ring mounted on said lower part of said housing and an inner ring mounted on said base connection piece.

9. A vertical spindle press for pressing out fluid from a material, such as sugar beet pulp, comprising a housing having a spray casing and a screen casing which is arranged within said spray casing so as to form an annular space therebetween; dewatering means connected with said annular space between said casings; a hollow spindle rotatable in said housing, forming with said screen casing an outlet annular gap for pressed material and being provided with a plurality of worm wings which extend outwardly substantially in contact with said screen casing, said hollow spindle having perforations for pressed out fluid and an interior space communicating with said dewatering means; filling means for feeding a material to be pressed into said housing; and a drive for driving said spindle in rotation and including drive means and a drive pipe which is driven by said drive means and drives said spindle from below, said drive pipe including an upper pipe member and a lower pipe member which are connected with one another and can be telescoped one inside the other and a coupling for connecting said upper pipe member and said lower pipe member with one another, said spindle having a side wall and a base with a base connection piece, said base connection piece including a ring which extends upwardly beyond said base and is sealed at its top, said ring together with said base and said side wall defining a first annular duct which is formed for receiving pressed out fluid and opens upwardly.

10. A spindle press as defined in claim 9, wherein said spindle has a longitudinal axis, said base being provided with a plurality of outlet connection pieces which are arranged on a circle concentric to said longitudinal axis of said spindle.

11. A spindle press as defined in claim 9, and further comprising a cover which seals said ring at its top and has at least one opening; a lock arranged to close each said opening of said cover and provided with a labyrinth gap seal.

12. A vertical spindle press for pressing out fluid from a material, such as sugar beet pulp, comprising a housing having a spray casing and a screen casing which is arranged within said spray casing so as to form an annular space therebetween; dewatering means connected with said annular space between said casings; a hollow spindle rotatable in said housing, forming with said screen casing an outlet annular gap for pressed material and being provided with a plurality of worm wings which extend outwardly substantially in contact with said screen casing, said hollow spindle having perforations for pressed out fluid and an interior space communicating with said dewatering means; filling means for feeding a material to be pressed into said housing; and a drive for driving said spindle in rotation and including drive means and a drive pipe which is driven by said drive means and drives said spindle from below, said drive pipe including an upper pipe member and a lower pipe member which are connected with one another and can be telescoped one inside the other and a coupling for connecting said upper pipe member and said lower pipe member with one another, said spindle having a longitudinal axis and a base, said dewatering means including an annular plate located below said base and radially outside said drive pipe, and a plurality of annular walls arranged at a distance from one another concentrically with said longitudinal axis and tightly connected with said annular plate, said spindle having a side wall, said base having a plurality of outlet connection pieces and together with said side wall defining a first annular duct, said annular walls including a first annular wall and a second annular wall which extend until the vicinity of said base and define a second annular duct between them and receive a lower end of said outlet connection pieces between them, said annular walls including a third annular wall which extends in a circumferential contact with said screen casing, and a fourth annular wall which extends in a close circumferential contact with said spray casing so that a third annular duct is defined between said third and fourth annular walls.

13. A spindle press as defined in claim 12, and further comprising at least one outlet opening for pressed out fluid provided between said first annular wall and said second annular wall, and at least one outlet opening provided between said third annular wall and said fourth annular wall.

14. A spindle press as defined in claim 13 and further comprising at least one collecting pipe located below said annular plate, and an intermediate connection piece connecting each said collecting pipe with a respective one of said outlet openings.

15. A spindle press as defined in claim 12 and further comprising means for emergency dewatering and including at least one line having one end which is open in a downward direction and another end which opens from above into each of said second and third annular ducts.

16. A spindle press as defined in claim 12 wherein said second annular wall and said third annular wall define a fourth annular duct therebetween for receiving pressed pulp; and further comprising at least one clearing wing which is fastened to said spindle and revolves in said fourth annular duct, said annular plate being provided in the region of said fourth annular duct with at least one outage opening for the pressed pulp; and a conveying device into which said outage opening opens.

17. A spindle press as defined in claim 12, wherein said spindle has an upper end area; and further comprising a fifth annular wall which encloses at a radial distance said upper end area of said spindle and defines with said screen casing an annular space for receiving the material to be pressed; an annular seal provided between said spindle and said fifth annular wall and means for tightly closing an upper end of said annular space.

18. A spindle press as defined in claim 17; and further comprising outer web plates fastening said fifth annular wall to said screen casing, said means for tightly closing said upper end of said annular space including an annular plate.

* * * * *